US007300059B2

(12) United States Patent
Caruso

(10) Patent No.: US 7,300,059 B2
(45) Date of Patent: Nov. 27, 2007

(54) CONNECTOR FOR SPORTS GOAL FRAME

(75) Inventor: Anthony Caruso, Center Valley, PA (US)

(73) Assignee: Kwik Goal Ltd., Quakertown, PA (US)

( * ) Notice: Subject to any disclaimer, the term of this patent is extended or adjusted under 35 U.S.C. 154(b) by 0 days.

(21) Appl. No.: 11/319,883

(22) Filed: Dec. 28, 2005

(65) Prior Publication Data

US 2007/0145688 A1 Jun. 28, 2007

(51) Int. Cl.
*A63B 63/00* (2006.01)
*F16B 7/04* (2006.01)

(52) U.S. Cl. ..... 273/400; 473/478; 403/297

(58) Field of Classification Search ..... 273/398–402, 273/407; 473/421, 454–456, 476–478; 403/297, 403/310; 285/404, 419, 373, 397, 370
See application file for complete search history.

(56) References Cited

U.S. PATENT DOCUMENTS

| | | | | |
|---|---|---|---|---|
| 3,532,369 | A | 10/1970 | Reilly | |
| 3,666,298 | A | 5/1972 | Reilly | |
| 4,273,462 | A | 6/1981 | Fukuchi | 403/171 |
| 4,334,797 | A | 6/1982 | Wahlin | 403/252 |
| 4,344,719 | A | 8/1982 | Thom | 403/297 |
| 4,570,408 | A | 2/1986 | Frascaroli et al. | 52/726 |
| 4,630,550 | A | 12/1986 | Weitzman | 108/155 |
| 4,691,818 | A | 9/1987 | Weber | 197/666 |
| 4,998,702 | A | 3/1991 | Reuter et al. | 248/278 |
| 5,061,000 | A | 10/1991 | Haugen et al. | 296/3 |
| 5,079,860 | A | 1/1992 | Nugent | 40/155 |
| 5,203,135 | A | 4/1993 | Bastian | 52/726.1 |
| 5,363,625 | A | 11/1994 | Philippi | 52/653.2 |
| 5,476,266 | A | 12/1995 | Caruso | 273/411 |
| 5,605,410 | A | 2/1997 | Pantev | 403/297 |
| 5,842,939 | A | 12/1998 | Pui et al. | 473/478 |
| 5,938,546 | A | 8/1999 | Caruso | 473/434 |
| 6,220,776 | B1 * | 4/2001 | Reeves | 403/102 |
| 6,261,196 | B1 | 7/2001 | Caruso | 473/476 |
| 6,324,988 | B1 | 12/2001 | Svensson | 104/89 |
| 6,446,313 | B2 | 9/2002 | Pfister | 24/514 |
| 6,726,255 | B1 * | 4/2004 | Ward | 285/373 |
| 2005/0008431 | A1 | 1/2005 | Albaugh | 403/297 |

OTHER PUBLICATIONS

KwikGoal, Assembly Instructions for 2B3306 Evolution Goal, 13 pages, Jan. 2005.

* cited by examiner

*Primary Examiner*—Mark S Graham
(74) *Attorney, Agent, or Firm*—Howson & Howson LLP

(57) ABSTRACT

An assembly including a tubular connector and at least one framing member having a hollow open end and a longitudinally-extending recessed channel. The recessed channel is formed by at least a pair of opposed inwardly-directed walls having inner peripheral surfaces that taper toward one another in a substantially V-shaped configuration. The connector is slidably received within the hollow end of the framing member and has a longitudinally-extending inset track for cooperatively receiving and engaging the tapered inner peripheral surfaces of the channel walls of the framing member. The inset track has outer peripheral surfaces formed by outwardly tapered walls, whereby when the inset track and recessed channel are urged together by a fastener, a slip-resistant joint is formed therebetween. Sports goal assemblies and methods of assembly are also disclosed.

13 Claims, 5 Drawing Sheets

FIG.6
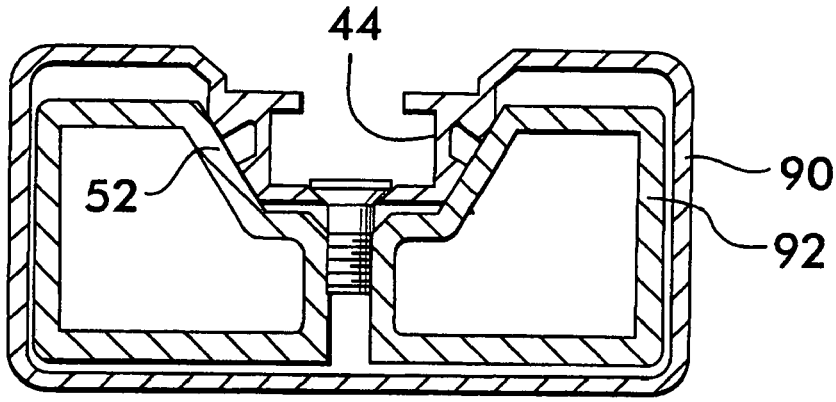
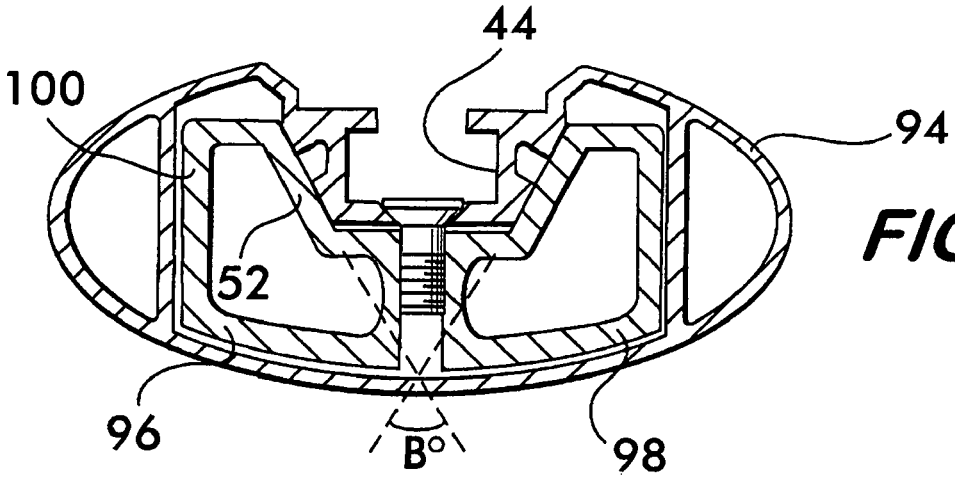
FIG.7
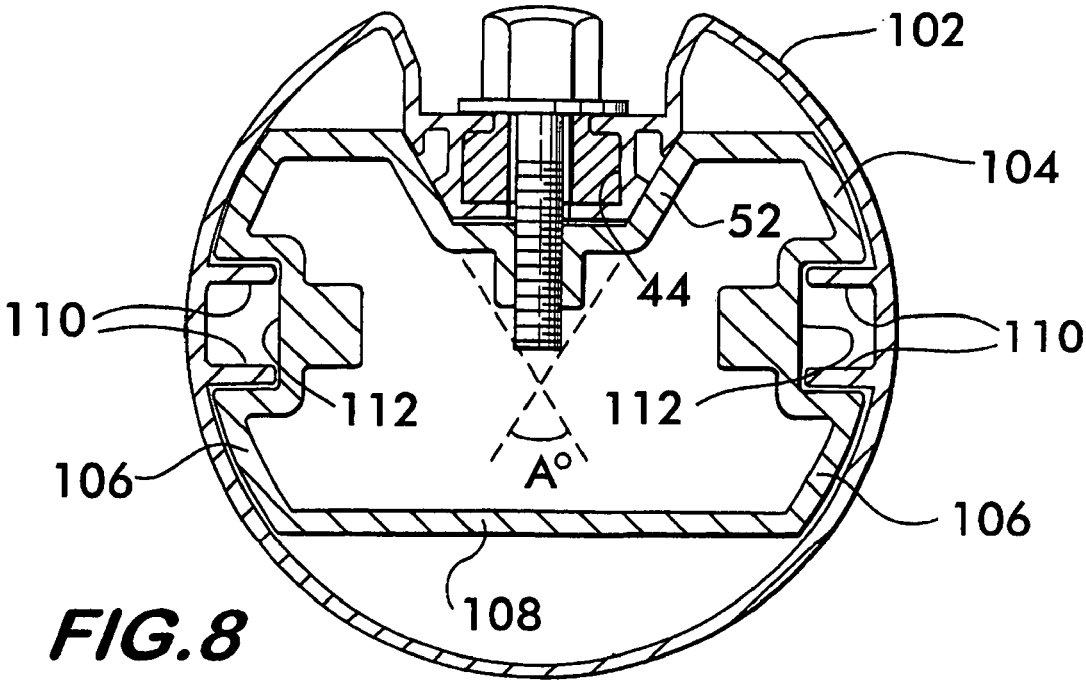
FIG.8

CONNECTOR FOR SPORTS GOAL FRAME

BACKGROUND OF THE INVENTION

The present invention relates to a connector for securing elongate framing elements together, and more particularly, the present invention relates to a sports goal frame assembly having wobble-free joints formed between elongate, hollow framing members.

A conventional goal, such as a soccer goal, includes an elongate crossbar extending horizontally between a pair of elongate, upright goal posts that together define a goal mouth. Goals typically include other framework members, such as, base bars that extend rearwardly from the base of the goal posts, a base cross bar that extends between the base bars, and/or backstays and the like that are used to suspend the net recessed from the goal mouth.

Various types of connectors are used to secure the ends of elongate framing members together. For example, U.S. Pat. No. 5,842,939 discloses a sports goal framework including a plurality of hollow tubular framing members joined together end-to-end by a plurality of mating connectors. Other examples of joints and connections, in general, are provided by U.S. Pat. Nos.: 3,532,369 and 3,666,298 issued to Reilly; U.S. Pat. No. 4,273,462 issued to Fukuchi; U.S. Pat. No. 4,344,719 issued to Thom; U.S. Pat. No. 4,334,797 issued to Wahlin; U.S. Pat. No. 4,570,408 issued Frascaroli et al.; U.S. Pat. No. 4,630,550 issued to Weitzman; U.S. Pat. No. 4,691,818 issued to Weber; U.S. Pat. No. 4,998,702 issued to Reuter et al.; U.S. Pat. No. 5,061,000 issued to Haugen et al.; U.S. Pat. No. 5,079,860 issued to Nugent; U.S. Pat. No. 5,203,135 issued to Bastian; U.S. Pat. No. 5,363,625 issued to Philippi; U.S. Pat. No. 5,605,410 issued to Pantev; U.S. Pat. No. 6,324,988 B1 issued to Svensson; and U.S. Pat. No. 6,446,313 B2 issued to Pfister and U.S. Patent Application Publication No. 2005/0008431 A1.

While the connectors and framing member assemblies disclosed in the above referenced patents and published application may function in an acceptable manner, there is a need for a connector enabling the ready formation of wobble-free joints between elongate framing members, such as between the framing members of a sports goal. The connector should prevent slippage between the members forming the joint and should enable a framework assembly, such as a sports goal frame, to be readily assembled in a minimum of time with a minimum of labor and skill.

BRIEF SUMMARY OF THE INVENTION

According to one aspect of the present invention, an assembly is provided that includes a connector and at least one framing member having a hollow open end and a longitudinally-extending recessed channel. The channel is formed by at least a pair of opposed inwardly-directed walls having inner peripheral surfaces that taper toward one another in a substantially V-shaped configuration. The connector is in the form of a sleeve slidably receivable within the hollow end of the framing member and has a longitudinally-extending inset track for cooperatively receiving and engaging the tapered inner peripheral surfaces of the channel walls of the framing member. The inset track has outer peripheral surfaces formed by outwardly tapered walls, whereby when the inset track and recessed channel are urged together by a fastener, a slip-resistant joint is formed therebetween.

According to another aspect of the present invention, a sports goal assembly is provided. The assembly includes a plurality of elongate, hollow goal frame members, such as a pair of goal posts, a crossbar, base bars, and a base crossbar. Each of the frame members has a longitudinally-extending recessed channel along a length thereof for use in securing a perimeter rope of a goal net therein, and each of the recessed channels is defined by at least a pair of opposed inwardly-directed walls having inner peripheral surfaces that taper toward one another. A plurality of sleeve-shaped hollow connectors are used to form joints between the goal frame members such that a portion of one connector is telescopically-received within each confronting end of each adjacent pair of goal frame members. Each connector has a longitudinally-extending inset track for cooperatively receiving and engaging the tapered inner peripheral surfaces of the channel walls of the goal frame members. The inset tracks have outer peripheral surfaces formed by outwardly tapered walls providing a V-shaped configuration that enable a slip-resistant joint to be formed.

According to a further aspect of the present application, a method of assembling a sports goal is provided. The above referenced goal frame members having longitudinally-extending recessed channels and sleeve-shaped connectors having longitudinally-extending, substantially V-shaped inset tracks are provided for assembly, and a length of one the connectors is inserted into a hollow end of one of the elongate goal frame members. A fastener is applied to the goal frame member such that the fastener extends through the recessed channel of the goal frame member and the inset track of the connector to urge the inwardly tapered inner peripheral surfaces of the walls of the recessed channel of the goal frame member into slip-resistant engagement with the outwardly tapered outer peripheral surface of the inset track of the connector.

BRIEF DESCRIPTION OF THE DRAWINGS

The features and advantages of the present invention should become apparent from the following description when taken in conjunction with the accompanying drawings, in which:

FIG. 6 is a cross-sectional view of a first alternate embodiment of a connector and goal frame member assembly;

FIG. 7 is a cross-sectional view of a second alternate embodiment of a connector and goal frame member assembly; and FIG. 8 is a cross-sectional view of a third alternate embodiment of a connector and goal frame member assembly.

DETAILED DESCRIPTION OF THE INVENTION

The present invention relates to connectors used to connect elongate framework members together to form a framework structure. As an example, the connector of the present invention can be used in the assembly of sport goal frames, such as soccer goals. Of course, the present invention can also be utilized for the construction of other goals as well as other non-sports related structures.

Figure 1:
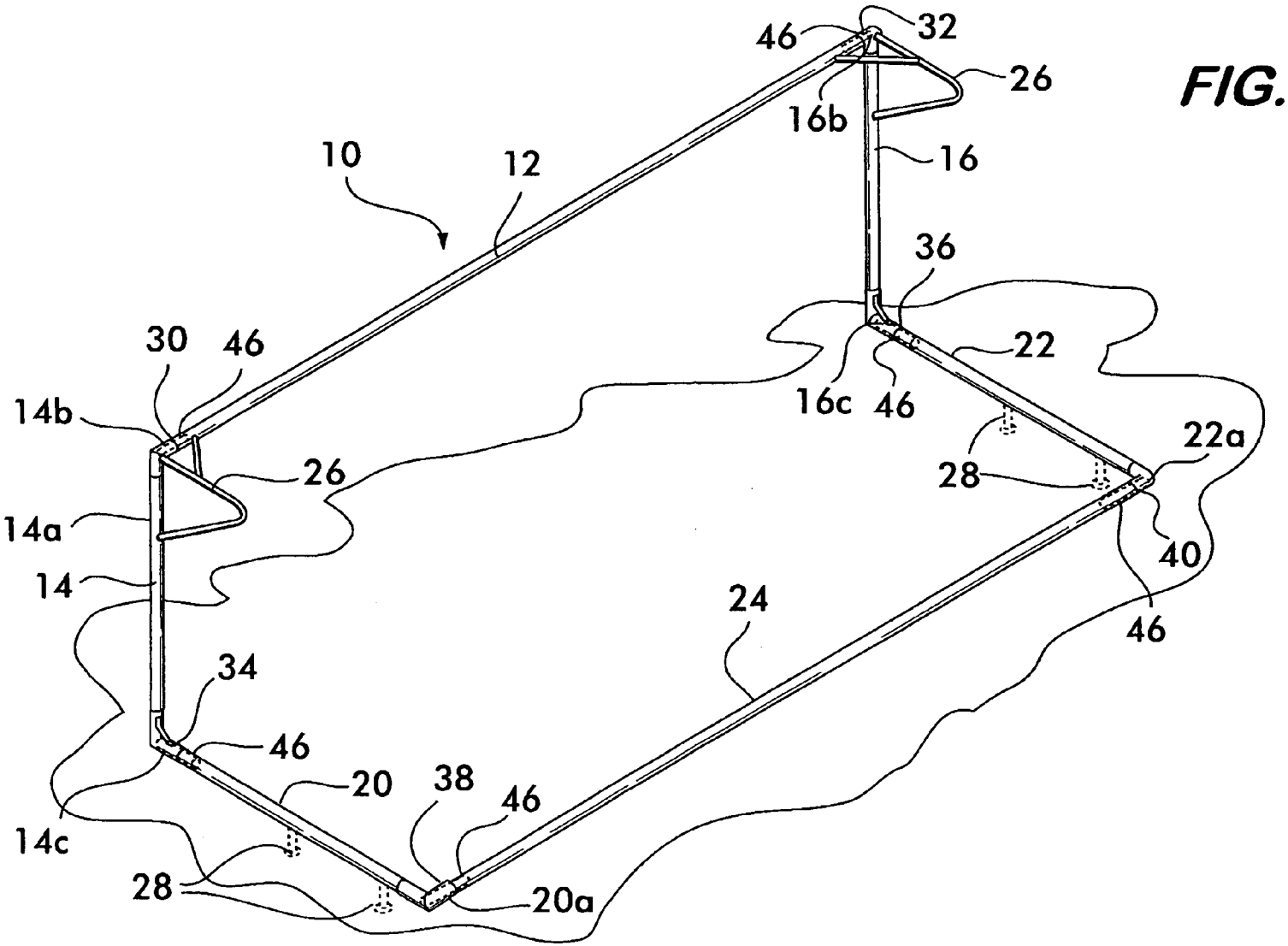
FIG. 1 is a perspective view of a goal frame assembly of a sports goal according to the present invention.

Various configurations of soccer goal frames are known in the art. The goal 10 illustrated in FIG. 1 provides an example. Typically, soccer goals include a crossbar 12 extending between and interconnecting the upper ends of a pair of upright, spaced-apart goal posts, 14 and 16. The goal posts and crossbar together define the goal mouth 18 of the goal 10.

A net (not shown) is typically secured to the soccer goal frame 10 such that the net is recessed behind the goal mouth 18. Accordingly, the soccer goal frame 10 includes a pair of base bars, 20 and 22, that extend rearwardly from the lower ends of the goal posts, 14 and 16. The frame 10 can also include a base crossbar 24 that extends between and interconnects the rearward ends of the base bars, 20 and 22. Backstays 26 and the like extend rearwardly from the upper ends of the goal posts, 14 and 16, to support the a spaced distance behind the crossbar 12. In the illustrated embodiment, the backstays 26 are substantially U-shaped and interconnect only with the goal posts. Other backstay configurations can be utilized such as those that extend from the upper end of the goal posts, 14 and 16, and interconnect to the rearward ends of the base bars, 20 and 22. Ground anchors 28 are connected to the base bars, 20 and 22, to secure the goal 10 to the underlying ground surface to prevent the goal from tipping over or from other undesired movement.

Joints are formed between each adjacent pair of confronting ends of the crossbar 12, goal posts 14 and 16, base bars 20 and 22, and base cross bar 24. In the illustrated embodiment, the goal post 14 includes an elongate post section 14*a*, an integral short-length lateral extension 14*b* welded to the upper end of the post section 14*a*, and an integral short-length rearward extension 14*c* welded to the lower end of the post section 14*a*. The goal post 16 is similar in construction to goal post 14 and includes integral short-length right angle extensions 16*b* and 16*c*. The base bars, 20 and 22, also include integral short-length right angle extensions 20*a* and 22*a*. Accordingly, an end-user assemblies the goal frame 10 by forming a total of six joints including: a joint 30 between the cross bar 12 and extension 14*b* of goal post 14; a joint 32 between the cross bar 12 and extension 16*b* of goal post 16; a joint 34 between the base bar 20 and extension 14*c* of goal post 14; a joint 36 between the base bar 22 and extension 16*c* of goal post 16; a joint 38 between the base crossbar 24 and extension 20*a* of base bar 20; and a joint 40 between the base crossbar 24 and extension 22*a* of base bar 22.

The above referenced goal frame and joint configuration provides only one example of a goal assembly. An alternate configuration is to provide each of the goal posts, base bars, crossbar, and base cross bar as a straight section without integral right angle extensions. In this case, separate elbow shaped framing pieces (not shown) would be provided to form each right angle connection. Each end of the elbow framing element would receive a separate connector and would connect to an elongate framing member. Thus, each elbow framing element would require the formation of two joints with two separate elongate framing elements and would thereby require the formation of a total of twelve joints for a goal assembly including goal posts, base bars, a crossbar and a base crossbar as discussed above.

Each of the above referenced framing members, 12, 14, 16, 20, 22 and 24, is substantially hollow end-to-end, or at least has hollow opposite ends. The cross-section of the outer peripheral surface 42 of the framing members, 12, 14, 16, 20, 22 and 24, can be substantially circular (see FIGS. 2-5 and 8), substantially oval (see FIG. 7), substantially rectangular (see FIG. 6), or any other multi-sided or curve-walled shape. In addition, preferably each of the framing members, 12, 14, 16, 20, 22 and 24, includes a longitudinally-extending inset channel 44 that extends throughout the length of the framing member. In the case of a sports goal frame, the channel 44 extends substantially continuously, or continually, along the rear of the goal posts 14 and 16 and crossbar 12 and along the top of the base bars 20 and 22 and base crossbar 24. Such a channel is capable of receiving the perimeter rope of a sports goal net which can be removably secured thereto with clips or fasteners that engage the channel. Such a net fastening system is described in U.S. Pat. No. 5,476,266 issued to Caruso which is owned by Kwik Goal Ltd., the assignee of the present application, and which is incorporated herein by reference. The Kwik Lock® Net Channel System has proven to be commercially successful due to the ease with which nets can be secured and removed from goal frames.

According to the present invention, a connector 46 is utilized to form the joint between the confronting ends of adjacent framing members. For example, as shown in FIG. 1 with dashed lines, separate connectors 46 extend within the goal frame 10, whereby each connector 46 spans across one of the joints, 30, 32, 34, 36, 38 and 40. The connectors have an exterior surface 48 that substantially conforms to the interior surface 50 of the framing member. Preferably, the connectors 46 are hollow and have a sleeve-type form.

An inset track 52 extends the length of each connector 46 and corresponds in shape to the inset channels 44 of the framing members. As best illustrated in FIGS. 3, 4 and 6-8, the inset tracks 52 are formed by walls 54 and 56 that provide an outwardly tapered, or beveled, outer peripheral surface 58. The inset track 52 also includes a longitudinally-extending base wall 60 having apertures 62 for receiving fasteners. The cross-sectional shape of the walls 54 and 56 is substantially "V"-shaped as shown in FIGS. 3, 4 and 6-8. As an example, the angle "A" at which the walls 54 and 56 extend relative to one another can be about 60°.

The recessed channels 44 of the framing members include walls 64 and 66 having at least sections thereof that have inner peripheral surfaces 68 that are inwardly tapered, for instance, in a "V"-shaped configuration. In some embodiments of the present invention, the inwardly tapered inner peripheral surfaces 68 can be discontinuous and include first and second spaced apart surfaces, 70 and 72, for instance as illustrated in FIGS. 3, 4 and 6-8. The inwardly tapered inner peripheral surfaces 68 extend an angle "B" between one another. Angles "A" and "B" are substantially equal so that the inner peripheral surfaces 68 of the channel 44 and the outer peripheral surfaces 58 of the track 52 cooperatively mate with one another.

Accordingly, when a portion of the connector 46 is telescopically received within a framing element, the recessed channel 44 of the framing member is received within the inset track 52 of the connector 46. One or more fasteners can be extended through the channel 44 and track 52 thereby urging the inner peripheral surfaces 68 of the channel 44 against the outer peripheral surfaces 58 of the track 52. This creates a tight joint and prevents any slippage or wobbling between the connector 46 and framing element even with framing elements and connectors manufactured within allowed ranges of tolerances. The V-shapes of the confronting surfaces compensate for any tolerances in size and permit the walls, 54, 56, 66 and 68, of the track 52 and channel 44 to be tightly brought together.

Figure 2:
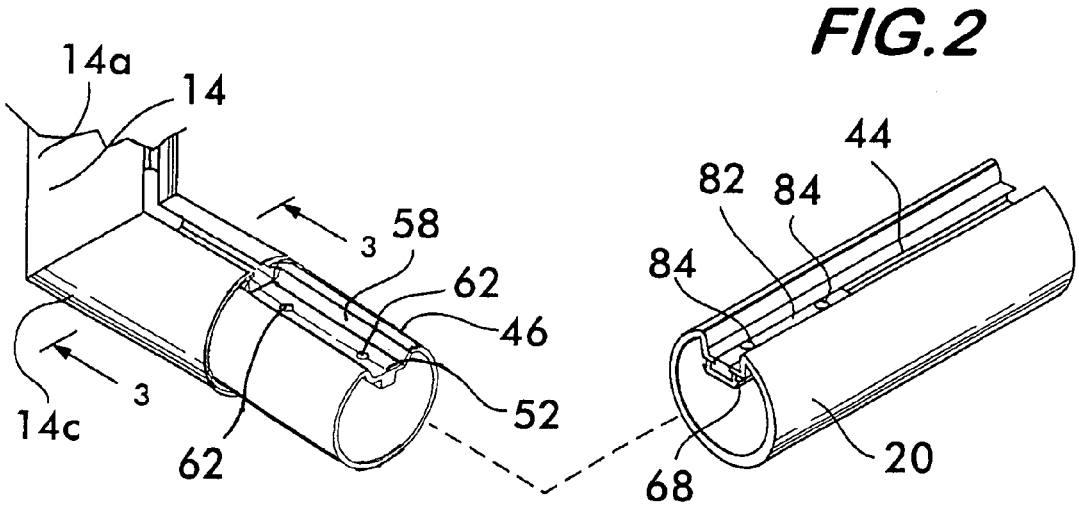
FIG. 2 is an exploded perspective view of a connector and goal frame member assembly according to the present invention.
Figure 3:
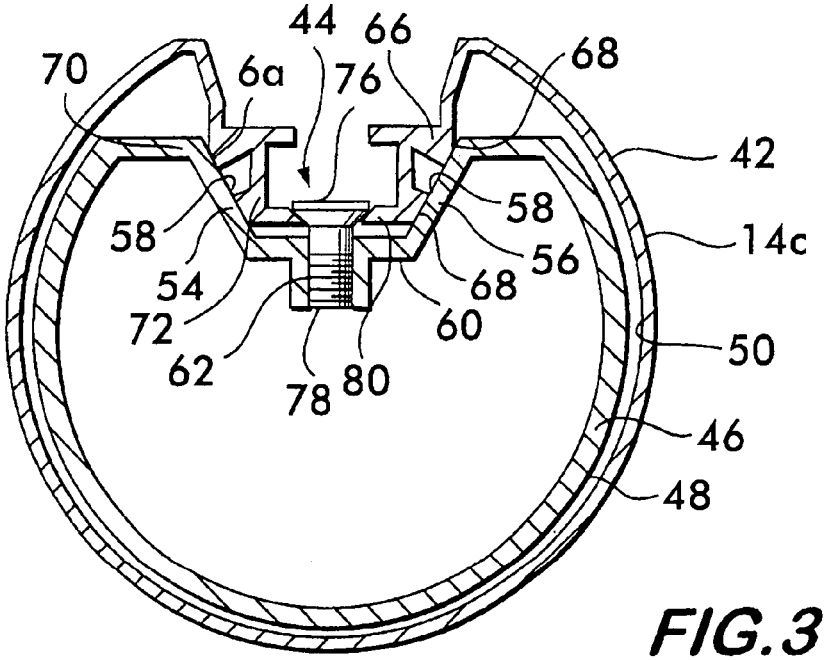
FIG. 3 is a cross-sectional view taken along line 3-3 of FIG. 2.

As best shown in FIG. 3, the head 76 of a fastener 78 can be sunk against the base wall 80 of the channel 44 and extend through and be secured by a threaded connection to the track 52. This fastener arrangement is typically utilized for pieces of the goal assembly as shipped from the manufacturer. For example, the goal posts 14 and 16 would have pre-installed connecters 46 extending from extensions 14*b*, 14*c*, 16*b* and 16*c*, and base bars 20 and 22 would have pre-installed connections extending from extensions 20*a* and 22*a*. FIG. 2 illustrates the joint 34 between the goal post 14 and the base bar 20. Alternatively, if elbow framing members are utilized, a connector 46 would extend from each end of the elbow.

Figure 4:
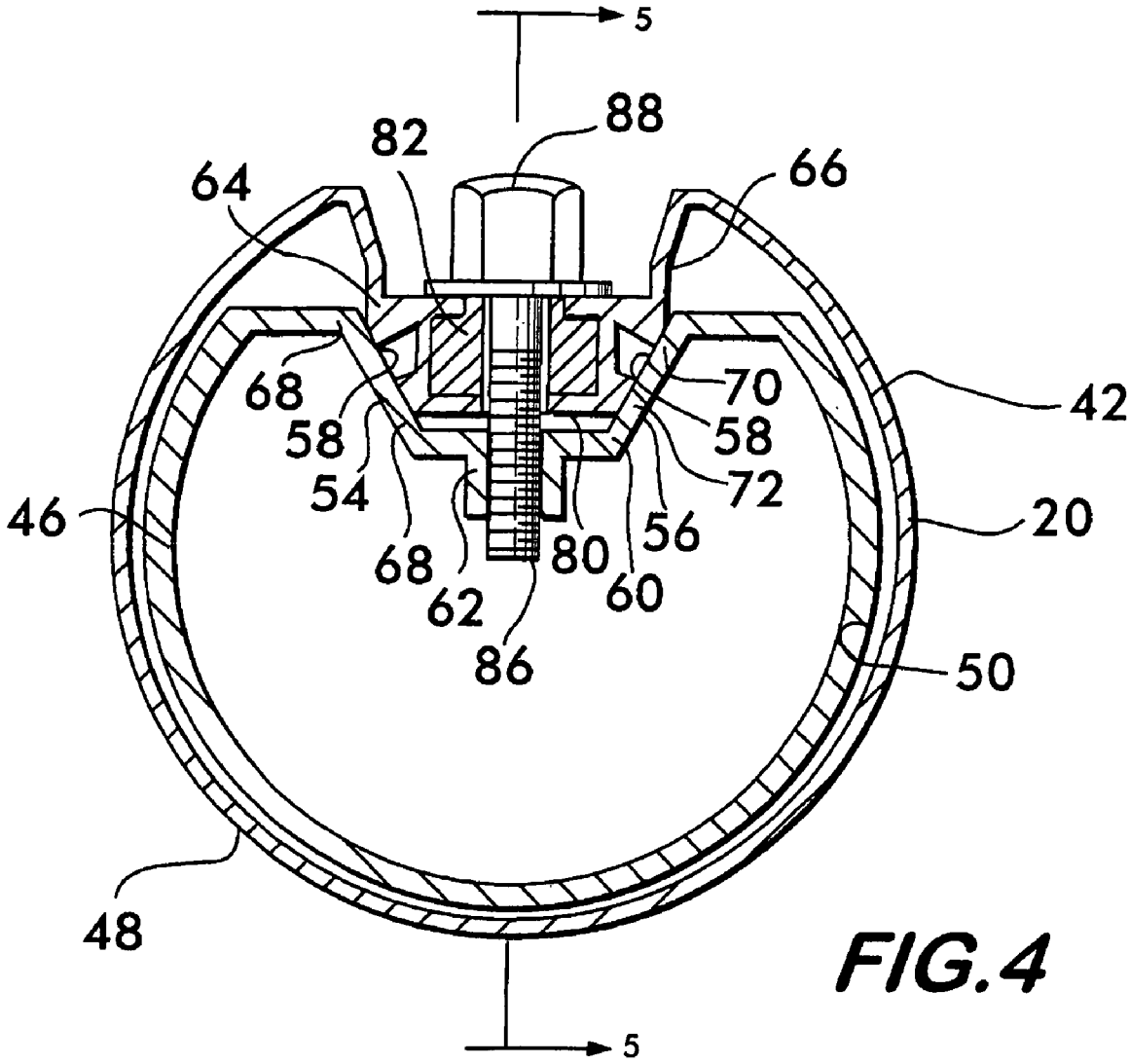
FIG. 4 is a cross-sectional view taken through the connector and the opposite goal frame member of FIG. 2.
Figure 5:
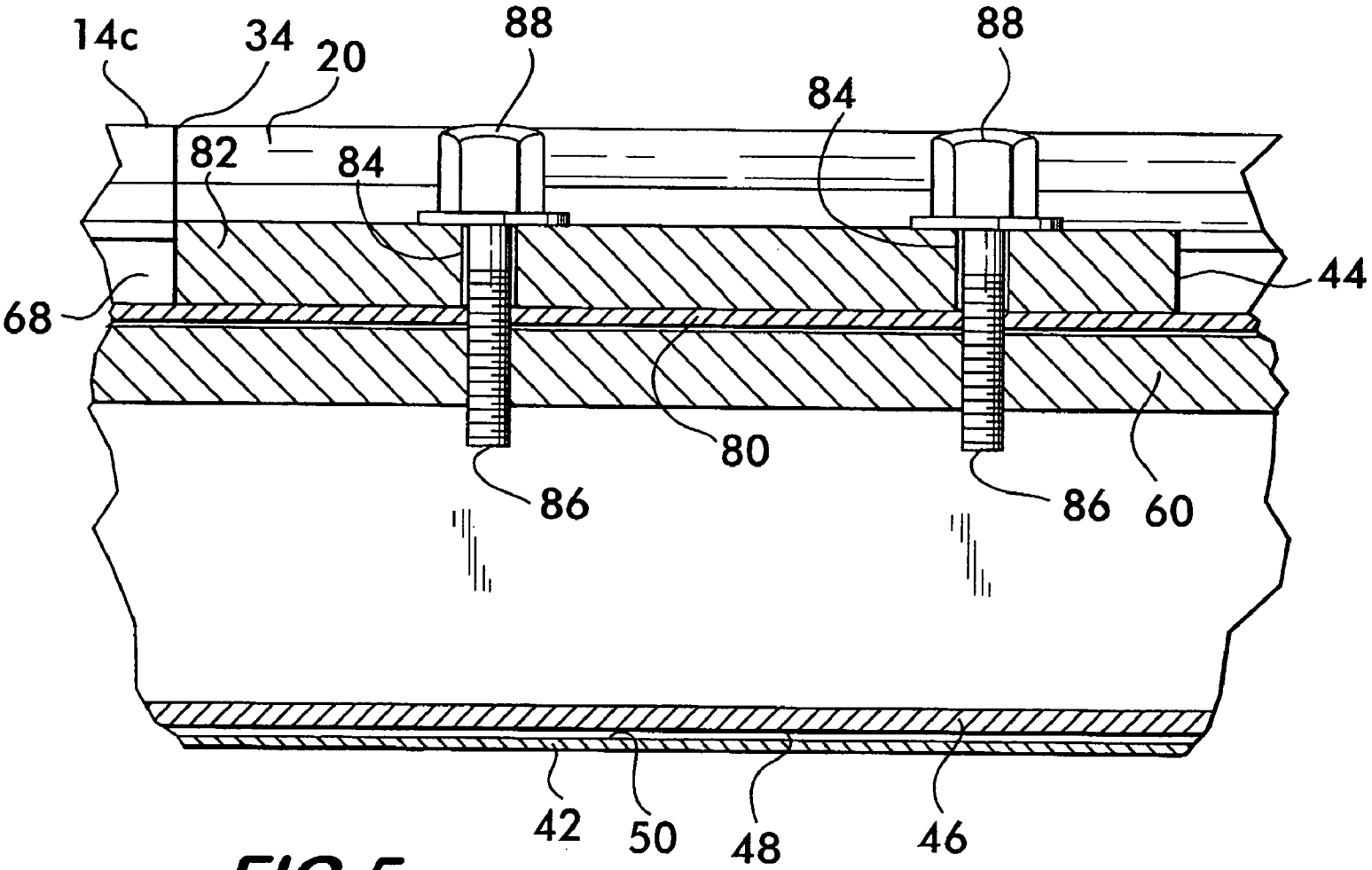
FIG. 5 is a cross-sectional view taken along line 5-5 of FIG. 4.

As best shown in FIGS. 4 and 5, a spacer element 82 can be located in the recessed channel 44 and have passages 84 extending therethrough for fasteners 86. When a spacer 82 is utilized, the head 88 of the fastener 86 is readily engaged by a wrench or like tool and can be applied through the spacer 82 for securement to the track 52 of the connector 46. This fastener arrangement is typically utilized by the end-user during the assembly of the goal frame. FIGS. 4 and 5 illustrate a portion of the connector 46 that extends from extension 14*c* of goal post 14 and is secured within the base bar 20.

FIGS. 6-8 illustrate various other framing member and connector shapes. For example, the hollow framing member 90 and connector 92 of FIG. 6 each has a generally rectangular cross-section, except for the channel 44 and track 52. The hollow framing member 94 of FIG. 7 is generally oval while the connector 96 includes both curved-wall and planar-wall sections, 98 and 100, respectively. In FIG. 8, the hollow framing member 102 has a generally circular cross-section while the connector 104 includes both curved-wall and straight-wall sections, 106 and 108, respectively. The framing member 102 includes inwardly extending alignment flanges 110 that are received with inwardly extending grooves 112 of the connector 104.

Preferably, all of the above referenced framing members and connectors are made of metal or a hard plastic. For example, the connectors 42 can be extrusions of aluminum. Of course, various other materials and processes for making the framing members and connectors can be utilized.

According to a method of the present application, framing members and connectors 46 are provided to a site in an unassembled condition. For example, the unassembled framing members can include separate goal posts 14 and 16, crossbar 12, base bars 20 and 22, and base cross bar 24. Preferably, the connectors 46 are pre-installed within one end of selected framing members. For example, connectors 46 can be pre-installed on both ends, 14*b*, 14*c*, 16*b* and 16*c*, of the goal posts, 14 and 16, and the rear end of each base bar, 20 and 22.

The exposed end of the connectors 46 are telescopically slid within the open end of the confronting framing member. For example, the connectors 46 extending from the upper ends of the goal posts 14 and 16 are slid into the opposite ends of the cross bar 12, the connectors 46 extending from the lower ends of the goal posts 14 and 16 are slid into the front ends of the base bars 20 and 22, and the connectors 46 extending from the rear ends of the base bars 20 and 22 are slid into the opposite ends of the base crossbar 24. Spacers 82 are positioned within the channel 44 and one or more fasteners 86 are applied through the recessed channels 44 of the framing members and into the inset tracks 52 of the connectors 46. The fasteners 86 are tightened to bring the inwardly tapered inner peripheral surfaces 68 of the recessed channel 44 into tight engagement with the outwardly tapered surfaces 58 of the inset tracks 52. This provides a desired slip-resistant and wobble-resistant joint.

After all joints are tightened, the goal frame 10 can be secured to an underlying ground, or playing, surface with ground anchors 28 and a perimeter rope (not shown) of a goal net can be secured within the longitudinally-extending recessed channels 44 extending throughout the framing elements. This is typically accomplished by applying a plurality of clips or fasteners (not shown) at spaced intervals along the recessed channels 44 to secure the perimeter rope to the goal frame 10.

The goal frame 10 can be unassembled by removing the fasteners 86 and sliding one end of the connectors 46 out of the framing elements. Thus, the goal frame 10 can be stored in a knockdown condition until re-assembled before the start of the next season.

While preferred connectors, framing member assemblies, goal frame assemblies, and methods have been described in detail, various modifications, alterations, and changes may be made without departing from the spirit and scope of the connectors, assemblies, and methods according to the present invention as defined in the appended claims.

The invention claimed is:

1. A connector and goal frame member assembly, comprising:

an elongate goal frame member having a longitudinally-extending recessed channel and a hollow open end, said recessed channel being defined by at least a pair of opposed inwardly-directed walls having inner peripheral surfaces that taper toward one another;

a connector slidably receivable within said hollow end of said goal frame member, said connector having an inset track for cooperatively receiving and engaging said tapered inner peripheral surfaces of said walls of said recessed channel of said goal frame member, said inset track having outer peripheral surfaces formed by outwardly tapered walls; and a fastener extending through said recessed channel of said goal frame member and said inset track of said connector to urge said inner peripheral surfaces of said walls of said recessed channel of said goal frame member into slip-resistant engagement with said outer peripheral surface of said inset track of said connector;

said tapered inner peripheral surface of each of said walls of said recessed channel being discontinuous in transverse cross-section and including a pair of spaced-apart surface portions.

2. A connector and goal frame member assembly, comprising:

an elongate goal frame member having a longitudinally-extending recessed channel and a hollow open end, said recessed channel being defined by a base wall and at least a pair of opposed inwardly-directed walls having inner peripheral surfaces that taper toward one another;

a connector slidably receivable within said hollow end of said goal frame member and being a single-piece elongate sleeve extending along a longitudinal axis between opposite ends, said sleeve being hollow from end to end along said longitudinal axis and being telescopically receivable within said hollow end of said goal frame member, said connector having an inset track for cooperatively receiving and engaging said tapered inner peripheral surfaces of said walls of said recessed channel of said goal frame member, said inset track having a base wall and outer peripheral surfaces formed by outwardly tapered walls; and a fastener extending through said base wall of said recessed channel of said goal frame member and said base wall of said inset track of said connector to urge said inner peripheral surfaces of said walls of said recessed channel of said goal frame member into slip-resistant engagement with said outer peripheral surface of said inset track of said connector.

3. An assembly according to claim 2, wherein said inset track has a substantially V-shaped profile in transverse cross-section.

4. An assembly according to claim 2, wherein an angle formed between said outwardly tapered walls of said inset track is about 60°.

5. An assembly according to claim 2, wherein said hollow end of said goal frame member has a shape in transverse cross-section that is substantially circular, oval, or rectangular.

6. A connector and goal frame member assembly comprising:

an elongate goal frame member having a longitudinally-extending recessed channel and a hollow open end, said recessed channel being defined by a base wall and at least a pair of opposed inwardly-directed walls having inner peripheral surfaces that taper toward one another;

a connector slidably receivable within said hollow end of said goal frame member, said connector having an inset track for cooperatively receiving and engaging said tapered inner peripheral surfaces of said walls of said recessed channel of said goal frame member, said inset track having a base wall and outer peripheral surfaces formed by outwardly tapered walls;

a fastener extending through said base wall of said recessed channel of said goal frame member and said base wall of said inset track of said connector to urge said inner peripheral surfaces of said walls of said recessed channel of said goal frame member into slip-resistant engagement with said outer peripheral surface of said inset track of said connector; and a separate channel spacer located within said recessed channel of said goal frame member on an exterior side of said goal frame member opposite said connector, said fastener extending through said channel spacer.

7. A sports goal assembly, comprising:

a plurality of elongate, hollow goal frame members each having a longitudinally-extending recessed channel along a length thereof for securement of a goal net thereto, each of said recessed channels being defined by at least a pair of opposed inwardly-directed walls having inner peripheral surfaces that taper toward one another;

a plurality of tubular connectors forming joints between said goal frame members to form the sports goal assembly, one of said connectors being telescopically-received within each confronting end of each adjacent pair of said goal frame members, each of said connectors having an inset track for cooperatively receiving and engaging said tapered inner peripheral surfaces of said walls of said recessed channel of said goal frame members, said inset tracks having outer peripheral surfaces formed by outwardly tapered walls; and at least one fastener in each of said joints securing said connector to each of said confronting ends of said goal frame members, said fasteners extending through said recessed channel of said goal frame member and said inset track of said connector to urge said inner peripheral surfaces of said walls of said recessed channel of said goal frame member into slip-resistant engagement with said outer peripheral surface of said inset track of said connector;

said tapered inner peripheral surface of each of said walls of said recessed channel being discontinuous in transverse cross-section and including a pair of spaced-apart surface portions.

8. A sports goal assembly, comprising:

a plurality of elongate, hollow goal frame members each having a longitudinally-extending recessed channel along a length thereof for securement of a goal net thereto, each of said recessed channels being defined by a base wall and at least a pair of opposed inwardly-directed walls having inner peripheral surfaces that taper toward one another;

a plurality of tubular connectors forming joints between said goal frame members to form the sports goal assembly, one of said connectors being telescopically-received within each confronting end of each adjacent pair of said goal frame members, each of said connectors having an inset track for cooperatively receiving and engaging said tapered inner peripheral surfaces of said walls of said recessed channel of said goal frame members, said inset tracks each having a base wall and outer peripheral surfaces formed by outwardly tapered walls; and in each of said joints, at least one fastener securing said connector to each of said confronting ends of said goal frame members, said fasteners extending through said base wall of said recessed channel of said goal frame member and said base wall of said inset track of said connector to urge said inner peripheral surfaces of said walls of said recessed channel of said goal frame member into slip-resistant engagement with said outer peripheral surface of said inset track of said connector; and in each of said joints, a separate channel spacer is located within said recessed channel of one of said confronting ends of said goal frame member on an exterior side of said goal frame member opposite said connector.

9. An assembly according to claim 8, wherein said tapered inner peripheral surfaces of said recessed channel and said outer peripheral surface of said inset track each has a substantially V-shaped profile in transverse cross-section.

10. An assembly according to claim 9, wherein said goal frame members have a shape in transverse cross-section selected from substantially circular, oval, and rectangular.

11. An assembly according to claim 9, wherein said plurality of goal frame members includes a pair of goal posts and a cross bar, and wherein one of said connectors is located between each of said goal posts and said cross bar.

12. An assembly according to claim 11, wherein said plurality of goal frame members includes a pair of base bars extending rearwardly of said goal posts and a base cross bar extending between said base bars, and wherein one of said connectors is located between each of said goal posts and said base bars and between each of said base bars and said base cross bar.

13. A method of assembling a sports goal, comprising the steps of:

obtaining an elongate goal frame member having a longitudinally-extending recessed channel defined by a base wall and at least a pair of opposed inwardly-directed walls having inner peripheral surfaces that taper toward one another, and a connector having an inset track for cooperatively receiving and engaging the tapered inner peripheral surfaces of the walls of the recessed channel of the goal frame member, the inset track having a base wall and outer peripheral surfaces formed by outwardly tapered walls;

inserting the connector into a hollow end of the elongate goal frame member;

applying a fastener to the goal frame member such that the fastener extends through the base wall of the recessed channel of the goal frame member and the base wall of the inset track of the connector to urge the inner peripheral surfaces of the walls of the recessed channel of the goal frame member into slip-resistant engagement with the outer peripheral surface of the inset track of the connector; and inserting a separate channel spacer within the recessed channel of the goal frame member on an exterior side of the goal frame member opposite the connector before said applying step such that, during said applying step, said fastener is extended through said channel spacer.

* * * * *